United States Patent [19]

Colbert

[11] Patent Number: 4,887,355

[45] Date of Patent: Dec. 19, 1989

[54] SNACK PACK OPENER

[76] Inventor: Brian S. Colbert, 1055 Palm Ave., Carlsbad, Calif. 92008

[21] Appl. No.: 202,478

[22] Filed: Jun. 6, 1988

[51] Int. Cl.[4] ..... B26B 3/00

[52] U.S. Cl. ..... 30/2; 30/295; 30/296.1; 225/19

[58] Field of Search ..... 83/856, 860, 926 K; 53/381 R; 222/80, 81; 30/2, 286, 296 R, 295, 312, 313, 340, 342, 353, DIG. 3; 225/19

[56] References Cited

U.S. PATENT DOCUMENTS

| | | | |
|---|---|---|---|
| 1,377,805 | 5/1921 | Clear | 83/912 |
| 1,886,021 | 11/1932 | Huff | 30/2 |
| 2,453,198 | 11/1948 | Corbett | 30/312 |
| 3,803,713 | 4/1974 | Jones et al. | 30/2 |

*Primary Examiner*—Douglas D. Watts
*Assistant Examiner*—Y Lin
*Attorney, Agent, or Firm*—Charles C. Logan, II; David L. Baker

[57] ABSTRACT

The invention is a device for opening heat sealed cellophane bags and packages. It is formed of a support bracket assembly, a doubled edged razor blade, and a safety guard assembly. The support bracket assembly is secured to the bottom surface of a cabinet or shelf. One end of the razor blade is inserted into a horizontal slot on the front wall of the support bracket assembly and it is secured in position by a screw. The other end of the razor blade is inserted into a horizontal slot in a vertical wall surface of the safety guard assembly and it is secured therein by a screw. The safety guard assembly is thus entirely supported by the razor blade and at a predetermined spaced distance from the front wall of the support bracket assembly so that a sealed cellophane bag or package can be drawn between their respective wall surfaces thus allowing the razor blade to cut off the heat sealed end of the bag.

5 Claims, 1 Drawing Sheet

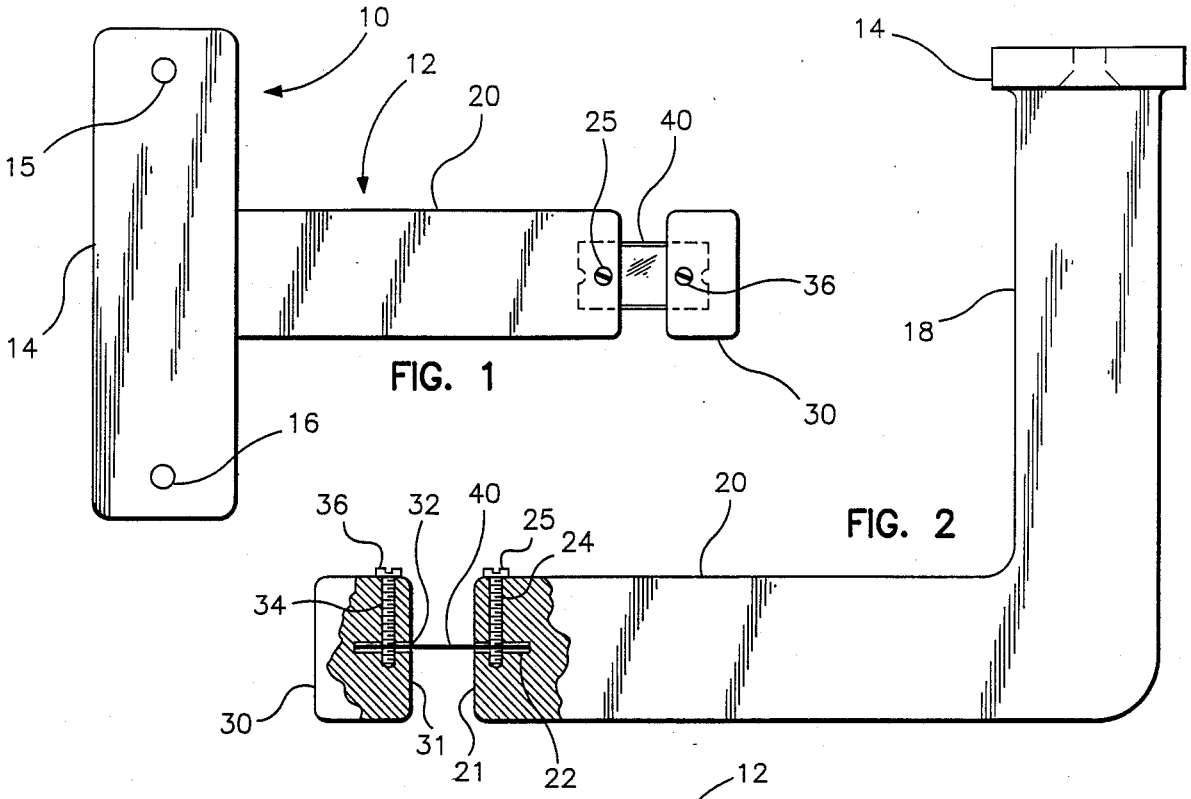
FIG. 1
FIG. 2
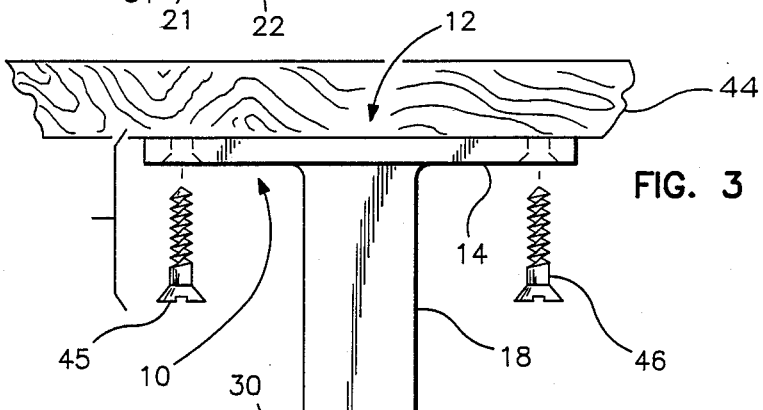
FIG. 3
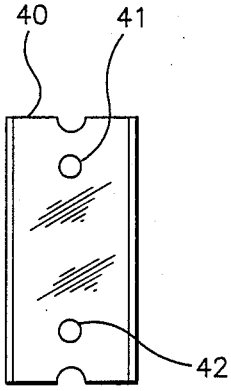
FIG. 4
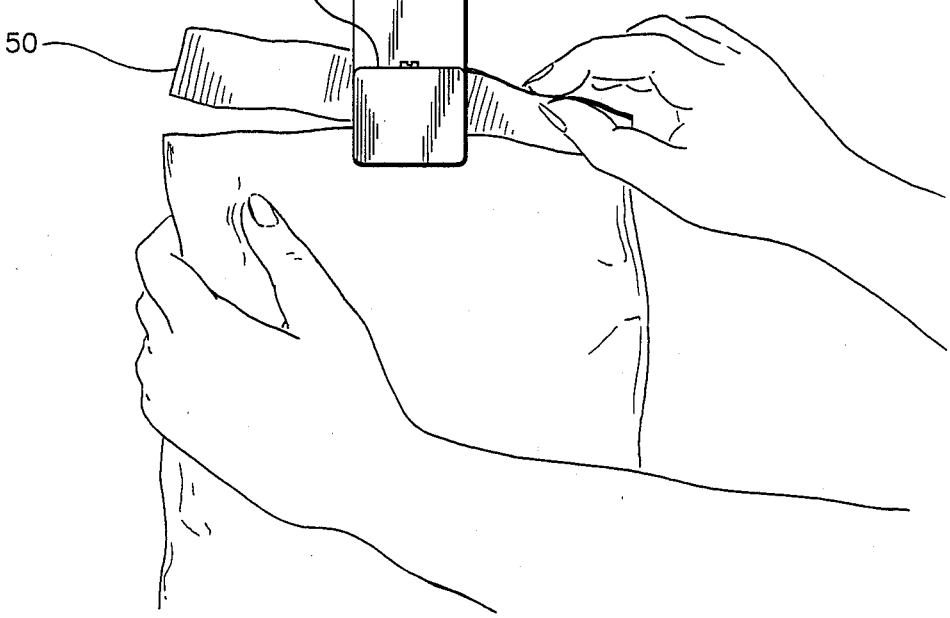

SNACK PACK OPENER

BACKGROUND OF THE INVENTION

The invention relates to a cutting device and more specifically to a device for cutting open sealed food bags.

Snack foods and other pre-packaged items are typically packaged in heat sealed cellophane bags or packages. These bags are often sealed so securly that they are difficult to open without a knife or scissors. Common practice is to puncture the bag with a knife or other pointed instrument and then tear the bag at the puncture line.

When cooking or preparing meals it is sometimes frustrating to attempt opening a well sealed cellophane bag. If the person has been cooking and has wet hands or a slippery substance on their hands, such as cooking oil, the opening of the bag can be overly time consuming and frustrating.

SUMMARY OF THE INVENTION

Applicant's novel snack pack opener has been designed for opening heat sealed cellophane bags or packages. His device has a support bracket assembly, a safety guard assembly and a double edged razor blade. The support bracket assembly has a plurality of pre-molded holes therein through which wood screws are inserted to fasten the support bracket assembly to the underside of a cabinet or shelf. The support bracket assembly has a downwardly extending neck portion to which is attached an outwardly extending arm so as to allow mounting of the support bracket assembly under a typical counter or cupboard with the curved arm protruding outwardly sufficiently to allow convenient use of the device.

The front wall surface of the protruding arm of the support bracket assembly has a horizontally oriented slot therein. A threaded bore hole extends inwardly from the top surface of the arm and intersects the horizontal slot. A machine screw would be threaded into this threaded bore and through the razor blade which has its one end detachably inserted in the horizontal slot. The opposite end of the razor blade is inserted into a horizontal slot in the adjacent wall surface of the safety guard assembly. It also has a threaded bore extending inwardly from its top surface that intersects its horizontal slot and a machine screw would be threaded therein to secure the respective end of the razor blade. The safety guard assembly is thus entirely supported by the razor blade. The safety guard assembly is designed to prevent accidental cuts or injuries and to keep the cutting edges of the razor from being exposed.

The snack pack opener uses commonly found double edged razor blades for its cutting member. These blades can be easily replaced when dull by unscrewing the machine screw fasteners and removing the old blade and replacing it with a new blade.

The snack pack opener provides a structure that is continually available for opening cellophane bags easily and quickly. The device is safe to use and gives its owner a structure for opening bags cleanly, even when the users hands are not clean or dry. The razor edge will instantly pierce the bag and cut a clean line across the top.

DESCRIPTION OF THE DRAWING

FIG. 1 is a top plan view of applicant's novel snack pack opener;

FIG. 2 is a side elevation view of the snack pack opener with portions broken away;

FIG. 3 is a front elevation view of the snack pack opener ilustrating the manner in which it is used for cutting the heat sealed cellophane bags; and FIG. 4 is a top plan view of a double edged razor blade such as is used with applicant's device.

DESCRIPTION OF THE PREFERRED EMBODIMENT

Applicant's novel snack pack opener will now be described by referring to FIG. 1–4 of the drawing. The snack pack opener is generally designated numeral 10.

Snack pack opener 10 has a support bracket assembly 12 having a cross member 14 with apertures 15 and 16. A neck portion 18 extends downwardly from the central area of cross member 14 and an arm 20 extends forwardly from its lower end. Arm 20 has a front wall 21 having a horizontal slot 22. A threaded bore 24 communicates with slot 22 and a machine screw 25 is threaded therein.

The safety guard assembly 30 has a vertical wall surface 31 having a horizontal slot 32. A threaded bore 34 is in communication with slot 32 and a machine screw 36 is threaded therein.

A double edged razor blade 40 has a pair of apertures 41 and 42. Aperture 41 receives machine screw 25 and aperture 42 receives machine screw 36. The safety guard assembly 30 is thus totally supported by razor blade 40.

The snack pack opener 10 is illustrated in FIG. 3 as it is attached to a horizontal shelf or platform 44. Screws 45 and 46 pass upwardly through apertures 15 and 16 respectively. The heat sealed cellophane bag 50 has its top end passed between the open space of respective walls 21 and 31 thus allowing the edge of razor blade 40 to cut a clean opening.

What is claimed is:

1. A snack pack opener comprising:

a support bracket assembly having means for securing it to the bottom surface of a cabinet or shelf;

a safety guard assembly;

an elongated razor blade having a first end and a second end;

said support bracket assembly and said safety guard assembly each having a vertical wall surface and these wall surfaces are spaced a predetermined distance apart;

means for detachably connecting the first end of said razor blade to the vertical wall surface of said support bracket assembly so that said razor blade extends therefrom in a cantilevered position; and means for detachably connecting the second end of said razor blade to the vertical wall surface of said safety guard assembly so that said safety guard assembly is entirely supported by said razor blade.

2. A snack pack opener as recited in claim 1 wherein said means for securing said support bracket assembly to the bottom surface of a cabinet or shelf comprises an elongated horizontally oriented cross member that has a flat top surface having a plurality of vertical apertures therein through which screws would be fastened.

3. A snack pack opener as recited in claim 2 wherein said support bracket assembly has a neck portion extending downwardly from said cross member.

4. A snack pack opener as recited in claim 3 wherein said support assembly has an arm extending horizontally from the bottom end of said neck portion.

5. A snack pack opener as recited in claim 1 wherein said razor blade is of the double edged type.

* * * * *